US005862631A

United States Patent [19]

Attaway et al.

[11] Patent Number: 5,862,631

[45] Date of Patent: Jan. 26, 1999

[54] FASCIA-GUTTER SYSTEM

[75] Inventors: Julian J. Attaway, Marietta; Larry M. Petree, Lawrenceville, both of Ga.

[73] Assignee: MM Systems Corporation, Tucker, Ga.

[21] Appl. No.: 740,858

[22] Filed: Nov. 4, 1996

[51] Int. Cl.[6] ..... F04D 13/00

[52] U.S. Cl. ..... 52/11; 52/94

[58] Field of Search ..... 52/11, 12, 15, 52/94–96, 60–62; 248/48.1, 48.2

[56] References Cited

U.S. PATENT DOCUMENTS

| | | | |
|---|---|---|---|
| Re. 27,761 | 9/1973 | Attaway | 52/60 |
| 3,533,201 | 10/1970 | Tyler | 52/60 |
| 3,667,717 | 6/1972 | Fasth | 52/11 |
| 3,824,749 | 7/1974 | Scherf | 52/11 |
| 4,128,974 | 12/1978 | Taylor | 52/11 |
| 4,199,121 | 4/1980 | LeFebvre | 52/12 |
| 4,262,459 | 4/1981 | Hallam | 52/11 |
| 4,404,777 | 9/1983 | Lolley et al. | 52/60 |
| 4,483,112 | 11/1984 | Rueblinger | 52/94 |
| 4,956,950 | 9/1990 | Hirose | 52/94 |
| 5,291,699 | 3/1994 | Fujita | 52/11 |
| 5,303,521 | 4/1994 | Jansen | 52/11 |

*Primary Examiner*—Lanna Mai
*Attorney, Agent, or Firm*—Needle & Rosenberg, P.C.

[57] ABSTRACT

A horizontally-disposed fascia, a longitudinally-extending gutter having a bottom member, and a plurality of support members for suspending the gutter so the bottom member of the gutter forms an angle with the horizontal plane. The gutter is disposed between the fascia and a building wall so the fascia-gutter of the present invention appears to be horizontally-oriented, while the gutter is angled to drain rainwater.

11 Claims, 2 Drawing Sheets

FASCIA-GUTTER SYSTEM

BACKGROUND OF THE INVENTION

1. Field of the Invention

The present invention relates to a fascia-gutter system in which the gutter is disposed at an angle relative to the horizontal plane and the external fascia is level with the horizontal plane.

2. Background Art

It has been known in the art to use a fascia that surrounds the perimeter of the roof of a building for aesthetic purposes. A fascia provides an architect flexibility in shaping the external appearance of the building. This is because of the available variety of colors and profiles. If available fascia designs are not satisfactory, the color and profile of the fascia can be customized to meet any design motif. Thus, a fascia maximizes the designer's flexibility in creating the desired exterior appearance of a building.

Most fascias in the prior art direct rainwater toward the center of the roof of the building. An example of a prior art fascia is disclosed in Reissue U.S. Pat. No. 27,761, reissued Sep. 18, 1973. The water is then removed by a drainage system from the roof of the building. Instead of directing the water toward the center of the building, it is desirable to combine a building with a gutter system. Also, there is an associated need in the art for the gutter to direct the rainwater to a drainage system, such as a downspout.

SUMMARY OF THE INVENTION

The present invention satisfies these and other needs in the art. The present invention encompasses a fascia-gutter system comprising a horizontally-disposed fascia, a longitudinally-extending gutter having a bottom member, and a means for suspending the gutter so the bottom member of the gutter forms an angle with the horizontal plane. The suspending means ensures that rainwater does not remain in the gutter but, instead, drains to the appropriate removal means, such as a downspout or other drainage system.

The gutter preferably is not visible to people outside the building, such as on the street or in adjacent building. The observers, instead, see only the horizontal fascia. Thus, the fascia-gutter system of the present invention appears horizontal, even though the bottom member of the gutter is angled to drain the rainwater.

The fascia comprises an elongated fascia member and a means for mounting the fascia member substantially upright with respect to the building wall. The mounting means preferably comprises a cant dam disposed intermediate the interior surface of the fascia member and the gutter, a means for detachably securing the fascia member to a section of the cant dam, and a plurality of support brackets that mount a portion of the cant dam substantially upright.

Each support bracket has a body portion in which one section of the body portion is fixedly attached to the first panel of the cant dam and another section of the body portion is fixedly attached to the building wall. Thus, the support brackets support the cant dam, and the cant dam supports and orients the fascia member.

The gutter is disposed intermediate the building wall and the cant dam and fascia member. The suspending means preferably comprises a portion of the bottom member of the gutter being disposed on and supported by at least a portion of the body section of the support brackets. The body portions of at least two support brackets are positioned at different elevations so that the bottom member of the gutter is disposed at an angle relative to the horizontal plane. It is preferred that a plurality of support brackets are disposed at a desired height along the building wall so that each support bracket for a respective longitudinal length of the gutter of the gutter is at a different elevation. Thus, the bottom member of the gutter is evenly distributed on the support members so that sagging and deformation of the gutter is prevented.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used.

The present invention encompasses a fascia-gutter system 10 for use adjacent the intersection of a building wall W and a roof deck D having an edge E. The fascia-gutter system 10 comprises a horizontally-disposed fascia 20, a longitudinally-extending gutter 90 having a bottom member 92, and a means for suspending the gutter 90 from a selected one of the building wall W or the edge E of the roof deck D so that at least a portion of the bottom member 92 of the gutter 90 forms an angle with the horizontal plane. The suspending means ensures that rainwater does not remain in the gutter 90 but, instead, drains to the appropriate removal means, such as a downspout (not shown) or other drainage system (not shown).

The fascia 20 is an aesthetically and architecturally pleasing structure disposed at the top of a building that is visible to someone outside the building. The gutter 90, which is positioned intermediate the building wall W or the roof deck D and the fascia 20, preferably is not visible to people outside the building, such as on the street or in an adjacent building. Thus, because only the horizontally-oriented fascia 20 is visible, the gutter 90 of the present invention is hidden from the view of observers, with the bottom member 92 of the gutter 90 forming an angle with the horizontal plane.

Figure 1:
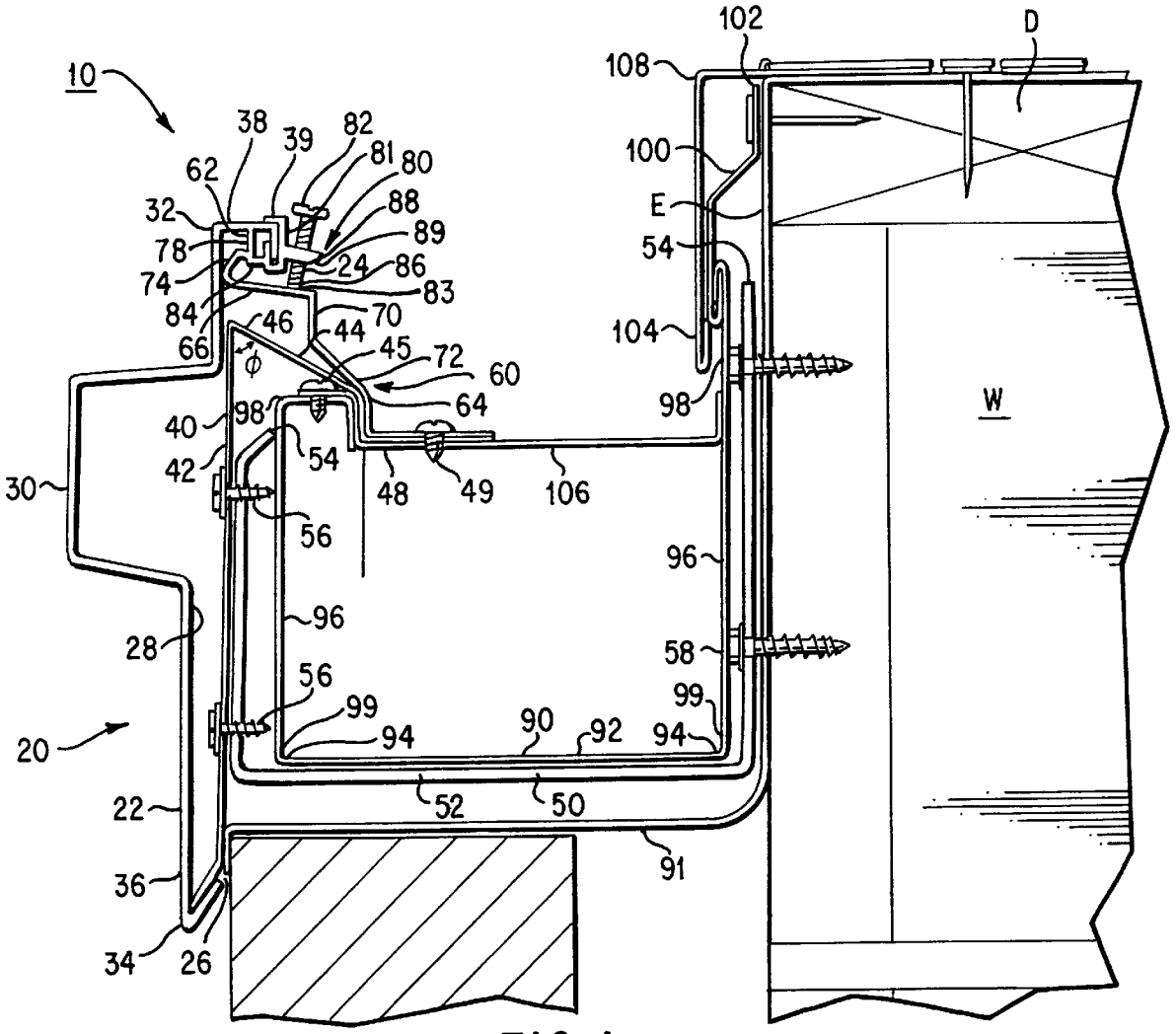
FIG. 1 is a side cross-sectional view of the present invention in a flush mount.

As shown in FIG. 1, the fascia-gutter system 10 of the present invention is disposed in a flush mount in a niche or indentation in the building wall W adjacent the top of the building. In this embodiment, the fascia 20 is substantially flush with the visible portion of the building wall W. Preferably, as would be readily known to one skilled in the art, a waterproof membrane 91, such as EPDM, is disposed below the bottom member 92 of the gutter 90 to direct for any leakage from the gutter 90 that may occur.

Figure 2:
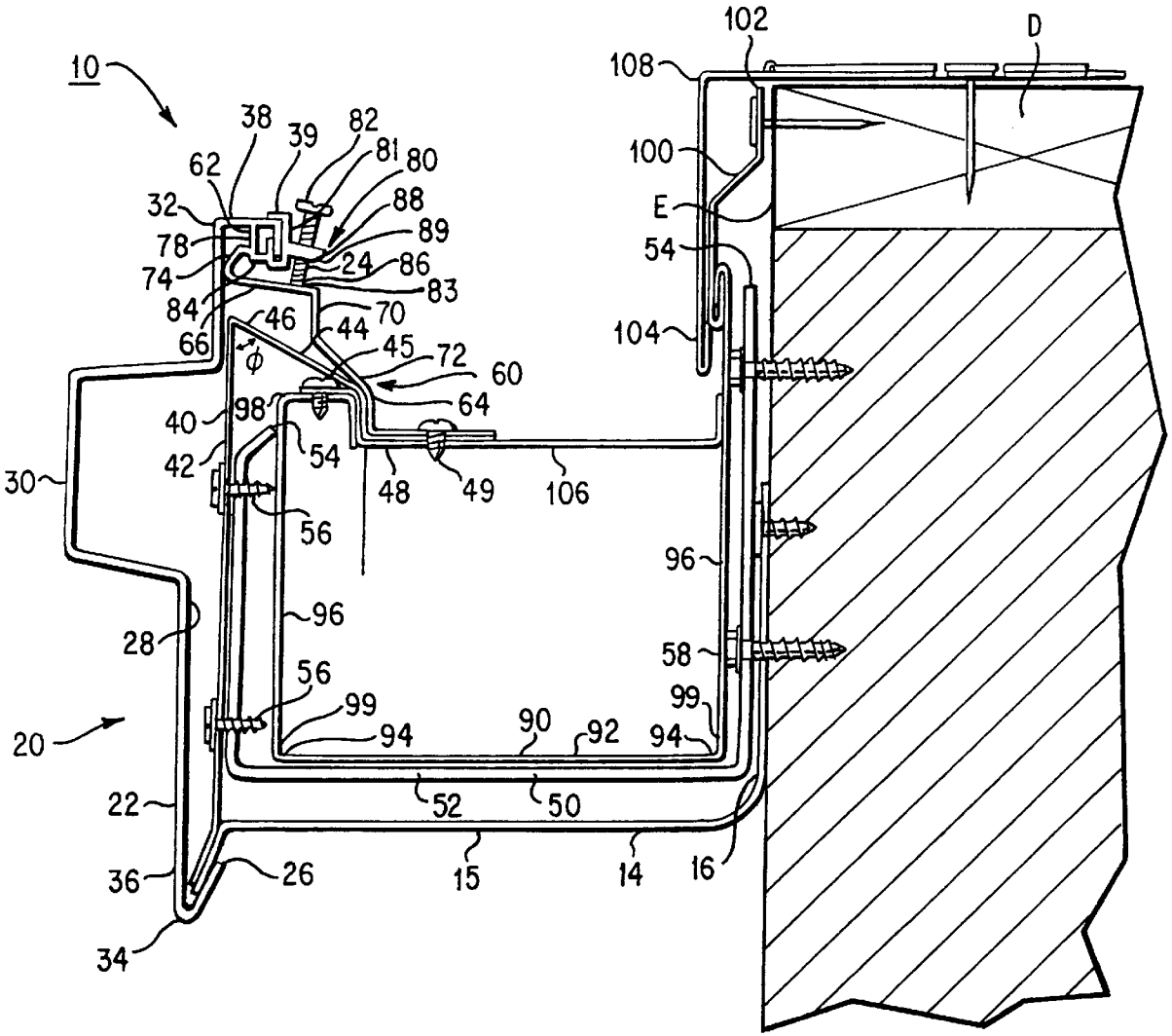
FIG. 2 is a side cross-sectional view of the present invention in a soffit closure.

Alternatively, the present invention can use a longitudinally-extending soffit closure 14, which is shown in FIG. 2, having a horizontal portion 15 that terminates into an upright portion 16. The horizontal portion 15 is disposed below the gutter 90 and extends from adjacent the fascia 20 to adjacent the building wall W. The upright portion 16 extends from the horizontal portion 15 along the building wall W and is fixedly attached thereto. To a person on the street, the soffit closure 14 makes the fascia-gutter system 10 of the present invention appear to be an integral unit in which the fascia 20 and the soffit closure 14 hide the gutter 90 from view.

Referring now to FIGS. 1 and 2, the fascia 20 comprises an elongated fascia member 22 and a means for mounting the fascia member 22 substantially upright with respect to the building wall W. The fascia member 22 has a top edge 24, a bottom edge 26, and an interior surface 28 directed toward the building wall W. The top and bottom edges 24, 26 are preferably parallel to each other and horizontally disposed.

The fascia member 22 preferably comprises an elongated, upright fascia wall 30 that terminates at its upper end 32 in a horizontally-disposed head component 38, which projects inwardly toward the building wall W. The fascia member 22 further comprises a finger 39 depending downwardly from the head component 38. The fascia wall 30 also has a bottom end 34 that curves upwardly and toward the building wall W to form a lower section 36. The lower section 36 terminates at the bottom edge 26 of the fascia member 22.

The fascia member 22 is preferably formed or extruded from an aluminum alloy or steel sheets, and it is particularly advantageous to use prepainted sheets. However, other suitable materials may be used.

One advantage of the present invention is that the fascia walls 30 are interchangeable with other fascia walls having a different design or color. Thus, a fascia-gutter system 10 having a desired appearance can be used for a specific building and another design or color for a different building.

The mounting means preferably comprises a cant dam 40 disposed intermediate the interior surface 28 of the fascia member 22 and the gutter 90, a means for detachably securing the fascia member 22 to a section of the cant dam 40, and a plurality of support brackets 50 that mount a portion of the cant dam 40 substantially upright. As shown, the cant dam 40 has an upright first panel 42 and a downwardly directed second panel 44, which are joined at their respective upper ends by a curved or angled section 46. At least a portion of the first panel 42 is disposed intermediate the interior surface 28 of the fascia wall 30 and the gutter 90. The second panel 44, which has an outer face 45, extends over a portion of the bottom member 92 of the gutter 90. It is preferred that the first panel 42 of the cant dam 40 be substantially upright and parallel to the fascia wall 30. The second panel 44 is at an incline so that an acute angle $\phi$ exists between the first and second panels 42, 44. The second panel 44 directs rainwater into the gutter 90. The preferred material for the cant dam 40 is galvanized steel.

Each support bracket 50 has a body portion 52 and opposed ends 54. One section of the support bracket 50 is fixedly attached to the first panel 42 of the cant dam 40, for example, by screws 56. As shown, each leading end of the screws 56 is adjacent a portion of the gutter 90, specifically an upright side member 96, which provides added support to the fascia-gutter device 10. Another section of the support bracket 50 is fixedly attached to a selected one of the building wall W or the edge E of the roof deck D, preferably, also by screws 58. Thus, one section fixedly attaches the support brackets 50 to a portion of the building wall W and the other section supports and orients the cant dam 40.

The means for detachably securing the fascia member 22 to the cant dam 40 preferably comprises a portion of the first panel 42 of the cant dam 40 being disposed within the lower section 36 of the fascia wall 30 and a means for urging the upper end 32 of the fascia wall 30 upwardly, thereby securably mounting the fascia wall 30 to the cant dam 40. A portion of the first panel 42 is received in and interlocked with the lower section 36 of the fascia wall 30.

To push or urge the upper end 32 of the fascia wall 30 upwardly, the fascia 20 preferably further comprises a flashing member 60 and a thrust means. The flashing member 60 has a top end 62 disposed adjacent the top edge 24 of the fascia member 22 and above the cant dam 40 and a lower end 64 disposed adjacent the second panel 44 of the cant dam 40. The flashing member 60 preferably comprises a first segment 66, a second segment 70, a third segment 72 which terminates in the lower end 64 of the flashing member 60, an arcuate segment 74, and an upwardly-extending leg 78 which terminates in the top end 62 of the flashing member 60.

The first segment 66 of the flashing member 60 has a slight downwardly directed slope, extending from its top end to its opposite lower end, from which the second segment 70 depends downwardly toward the cant dam 40 and the gutter 90. The second segment 70 terminates in the third segment 72, which also has a downwardly-oriented slope. The third segment 72 is directed toward the building wall W and terminates at the lower end 64 of the flashing member 60. The lower end 64 of the flashing member 60 extends parallel to and engages on its bottom surface a portion of the outer face 45 of the second panel 44 of the cant dam 40.

The arcuate segment 74 of the flashing member 60 has a lower end connected to the first segment 66. At least a portion of the arcuate segment 74 is adjacent the interior surface 28 of the fascia wall 30. The arcuate segment 74 does not necessarily have to have a continuous curvature and may, for example, have a squared "C" shape in cross-section. The upper end of the arcuate section terminates in the upwardly-extending leg 78 having a top end 62 disposed adjacent to and beneath the head component 38 of the fascia member 22. It is preferred that the leg 78 be vertically disposed; however, the leg 78 can alternatively extend upwardly at an acute angle with the horizontal plane as, for example, at a thirty (30) degree angle.

The thrust means directs the top end 62 of the flashing member 60 in an upward direction toward a portion of the fascia member 22 and presses the lower end 64 of the flashing member 60 against the second panel 44 of the cant dam 40. One example of the thrust means is disclosed in Reissue U.S. Pat. No. 27,761, which is hereby incorporated by reference.

However, the preferred thrust means, shown in FIGS. 1 and 2, comprises at least one clip 80 having an adjusting means that adjustably positions a portion of the clip 80 away from the first segment 66 of the flashing member 60. The adjusting means, together with the clip 80, directs the top end 62 of the flashing member 60 towards the head component 38 of the fascia member 22 and presses the bottom end of the third segment 72 of the flashing member 60 against a portion of the second panel 44 of the cant dam 40. The upper end 32 of the fascia wall 30, the head component 38, and the finger 39 define a recess therebetween, into which the clip 80 and adjusting means position the top end 62 of the flashing member 60.

Each clip 80 has an elongated body portion 81, a means on the body portion 81 for engaging the fascia member 22, and a first protrusion 84 extending from the body portion 81 toward the interior surface 28 of the fascia wall 30. The engaging means comprises the clip 80 defining a slot 86 therein which is of a size to slidably and detachably receive therein the finger 39 of the fascia member 22. The finger 39 of the fascia member 22, when is disposed in the slot 86, stabilizes and directs the clip 80 as the adjusting means is varied.

The first protrusion 84 of the clip 80 has an upper surface that engages a section of the arcuate segment 74 of the flashing member 60. The upper surface of the clip 80 can, alternatively, engage the leg 78 or other portion of the flashing member 60 so that the flashing member 60 interfaces with the clip 80.

The preferred clip 80 further comprises a second protrusion 88 extending from the body portion 81 that is oppositely directed from the first protrusion 84. As shown in the Figures, the adjusting means comprises an opening 89 through the second protrusion 88 of the clip 80 and a screw 82 received therethrough. The screw 82 has a bottom, or shank, end 83 so that when the screw 82 is selectively adjusted relative to the opening 89 in the second protrusion 88, the bottom end 83 of the screw 82 engages the first segment 66 of the flashing member 60. Once in this position, further downward movement of the screw 82 causes the lower end 64 of the flashing member 60 to press clampingly against a portion of the outer face 45 of the second panel 44 of the cant dam 40 and, concurrently, directs the top end 62 of the flashing member 60 toward the head component 38. This improves the structural stability of the fascia-gutter system 10.

The opening 89 in the second protrusion 88 of the clip 80 can be threaded, drilled, or punched. If the opening is threaded, then a complementarily threaded screw is used. If the opening 89 is not threaded, then a self-tapping screw can be used. As one skilled in the art will appreciate, many variations are possible, including disposing the second protrusion 88 at a different location on the clip 80 and at a different angle relative to the body portion 81.

One skilled in the art will also appreciate that other adjusting means can be used, such as a fastener (not shown) disposed through a complementarily-shaped opening in the second protrusion 88. The fastener, which has flanges that allow movement in one direction and inhibit movement in the opposite direction, is pushed downwardly until the leading end of the fastener contacts the first segment 66 of the flashing member 60 with the desired pressure, similar to the screw embodiment. The flanges on the fastener maintain its position and, therefore, the pressure on the first segment 66 of the flashing member 60. Examples of other adjusting means that can be used include a spring means (not shown), racheting means (not shown), or similar device that pushes the clip 80 away from the first segment 66 of the flashing member 60.

Referring again to FIGS. 1 and 2, the gutter 90 is disposed intermediate the interior surface 28 of the fascia member 22 and the building wall W. The gutter 90 has two opposed upright side members 96 and bottom member 92 disposed therebetween. Each side member 96 of the gutter 90 has a first edge 98 and an opposed second edge 99, and the bottom member 92 has two laterally opposed edges 94. Each edge 94 of the bottom member 92 terminates in the second edge 99 of the adjacent side member 96. One side member 96 of the gutter 90 is preferably disposed adjacent the first panel 42 of the cant dam 40 and the other side member 96 of the gutter 90 is disposed adjacent the building wall W. As shown, the gutter 90 has a squared "U" shape in cross section. Those skilled in the art will appreciate that the cross section of the gutter can be a curved "U" shape, "V" shaped, a semi-circle, or any other shape that can collect and direct rainwater.

The suspending means preferably comprises a portion of the bottom member 92 of the gutter 90 being disposed on and supported by at least a portion of the body portion 52 of the support brackets 50. The body portions 52 of at least two support brackets 50 are positioned at different elevations so that the bottom member 92 of the gutter 90 is disposed at an angle relative to the horizontal plane. All of the support brackets 50 are preferably disposed at a desired height along the building wall W so that each support bracket 50 is of a different elevation and supports the gutter 90 at a point along its longitudinal length. The gutter 90, accordingly, is disposed on and supported by each of the support brackets 50 so that each support bracket 50 supports a portion of the bottom member 92 of the gutter 90. Thus, each of the support brackets 50 aligns linearly with a respective adjacent bracket so that the bottom member 92 of the gutter 90 disposed thereon forms an angle with the horizontal plane. Although the support brackets 50 are aligned so that they support a portion of the gutter 90 at an angle, the cant dam 40, which is attached to an end of the support member, is disposed so that the attached fascia member 22 is horizontally disposed.

The bottom member 92 of the gutter 90 preferably slopes at a vertical drop of approximately 1/16th to ½ of an inch drop per longitudinal foot that the gutter 90 extends. As one skilled in the art will appreciate, the slope can be varied, depending upon different factors including the size of the building, separation between downspouts or other drainage systems, expected rainfall, capacity of the gutters, and the like.

The suspending means preferably further comprise a gutter hook strip 100 having an upper edge 102 fixedly attached to a selected one of the building wall W or the edge E of the roof deck D and a lower edge 104 attached to the first edge 98 of the side member 96 that is disposed adjacent the building wall W. As shown, the gutter hook strip 100 attaches to the gutter 90 by having a portion adjacent its lower edge 104 looped upward so that it forms a longitudinally-extending pocket. A portion of the side member 96 adjacent the building wall W is complementarily received within the pocket of the gutter hook strip 100. As shown, a drip edge 108 is added adjacent the upper edge 102 of the gutter hook strip 100 for aesthetic purposes and for protecting the gutter hook strip 100 from the elements.

In conjunction with the support brackets 50, it is also preferred that the suspending means further comprise a gutter strap 106 laterally disposed across the gutter 90. The gutter strap 106 is attached on each of its ends to the two side members 96 of the gutter 90. The gutter strap 106 supports the gutter 90, decreasing the likelihood of lateral deformation of the side members 96. To increase the stability of the fascia-gutter system 10, it is advantageous to add a third panel 48 to the cant dam 40 that depends from the second panel 44. A portion of the third panel 48 contacts the gutter strap 106. The third panel 48 is fixedly attached to the gutter strap 106, such as by a screw 49 shown in FIGS. 1 and 2.

As one skilled in the art will appreciate, an advantage of the support brackets 50 is that it allows the gutter 90 to expand and contract for changes in the temperature that may occur, and the gutter hook strip 100 and gutter strap 106 do not interfere with this feature.

The suspending means may comprises another embodiment in which the gutter hook strip 100 supports the gutter 90 alone instead of in conjunction with the support members. The gutter hook strip 100 is positioned at an angle relative to the horizontal plane so that the bottom member 92 of the gutter 90 is correspondingly disposed at an angle relative to the horizontal plane. This embodiment is less desirable, however, because it has less structural strength than the embodiment using support members 50.

Although the present invention has been described with reference to specific details of certain embodiments thereof, it is not intended that such details should be regarded as limitations upon the scope of the invention except as and to the extent that they are included in the accompanying claims.

What is claimed is:

1. A fascia-gutter system for use adjacent the intersection of a building wall and a roof deck, the fascia-gutter system comprising:

a. a fascia comprising:

i. an elongated fascia member having a top edge, a bottom edge, and an interior surface, and ii. means for mounting the interior surface of the fascia member substantially upright and the top edge of the fascia member substantially level with a horizontal plane;

b. a longitudinally-extending gutter having two opposed upright side members and a bottom member disposed therebetween, wherein each side member has a first edge and an opposed second edge, wherein the bottom member has two laterally opposed edges, each edge of the bottom member terminating into the second edge of the adjacent side member, the gutter being disposed adjacent the interior surface of the fascia member; and c. means for suspending the gutter so that at least a portion of the bottom member of the gutter forms an angle with the horizontal plane, wherein the mounting means comprises:

i. a cant dam disposed intermediate the interior surface of the fascia member and the gutter;

ii. means for detachably securing the fascia member to the cant dam; and iii. a plurality of support brackets that mount the cant dam substantially upright, each support bracket having a body portion in which a section of the body portion is fixedly attached to the cant dam and another section of the body portion is fixedly positioned at a desired location.

2. The fascia-gutter system of claim 1, wherein the suspending means comprises a portion of the bottom member of the gutter being disposed on and supported by at least a section of the body portion of the support brackets, wherein the body potion of at least two support brackets are positioned at a different elevations so that the bottom member of the gutter is disposed at an angle relative to the horizontal plane.

3. The fascia-gutter system of claim 2, wherein one side member of the gutter is disposed adjacent the interior surface of the fascia member and wherein the suspending means further comprises a gutter hook strip having an upper edge fixedly positioned and a lower edge attached to the first edge of the side member of the gutter.

4. The fascia-gutter system of claim 3, wherein the suspending means further comprises a gutter strap laterally disposed across the gutter, the gutter strap being attached to the two side members of the gutter.

5. The fascia-gutter system of claim 3, wherein the fascia further comprises:

a. a flashing member having a top end disposed above the cant member and adjacent the top edge of the fascia member and a lower end disposed adjacent a portion of the cant member; and b. thrust means for directing the top end of the flashing member in an upward direction toward the fascia member and for pressing the lower end of the flashing member against the portion of the cant member.

6. The fascia-gutter system of claim 5, further comprising a longitudinally-extending soffit closure having a horizontal portion that terminates into an upright portion, the horizontal portion being disposed below the gutter and extending away from adjacent the interior surface of the fascia member, the upright portion extending upwardly from the horizontal portion and being fixedly positioned.

7. The fascia-gutter system of claim 1, wherein the fascia further comprises:

a. a flashing member having a top end disposed above the cant member and adjacent the top edge of the fascia member and a lower end disposed adjacent a portion of the cant member; and b. thrust means for directing the top end of the flashing member in an upward direction toward the fascia member and for pressing the lower end of the flashing member against a portion of the cant member.

8. A fascia-gutter system, comprising:

a. a building having a building wall and a roof deck, the roof deck having an edge;

b. a fascia comprising:

i. an elongated fascia member having a top edge, a bottom edge, and an interior surface directed toward a portion of the building wall; and ii. means for mounting the fascia member substantially upright with respect to the building wall and substantially level with a horizontal plane;

c. a longitudinally-extending gutter having two opposed upright side members and a bottom member disposed therebetween, wherein each side member has a first edge and an opposed second edge, wherein the bottom member has two laterally opposed edges, each edge of the bottom member terminating into the second edge of the adjacent side member, the gutter being disposed intermediate the interior surface of the fascia member and a selected one of the building wall or the edge of the roof deck; and d. means for suspending the gutter from a selected one of the building wall or the edge of the roof deck so that at least a portion of the bottom member of the gutter forms an angle with the horizontal plane, wherein the mounting means comprises:

i. a cant dam disposed intermediate the interior surface of the fascia member and the gutter;

ii. means for detachably securing the fascia member to the cant dam; and iii. a plurality of support brackets that mount the cant dam substantially upright, each support bracket having a body portion in which a section of the body portion is fixedly attached to the cant dam and another section of the body portion is fixedly attached to a selected one of the building wall or the edge of the roof deck.

9. The fascia-gutter system of claim 8, wherein one side member of the gutter is disposed adjacent a portion of the interior surface of the fascia member and the other side member of the gutter is disposed adjacent the building wall, wherein the suspending means comprises a gutter hook strip having an upper edge fixedly attached to a selected one of the building wall or the edge of the roof deck and a lower edge attached to the first edge of the side member disposed adjacent the building wall, wherein the gutter hook strip supports the gutter and wherein the gutter hook strip is positioned at an angle relative to the horizontal plane so that the bottom member of the gutter is disposed at an angle relative to the horizontal plane.

10. The fascia-gutter system of claim 8, further comprising a longitudinally-extending soffit closure having a horizontal portion that terminates into an upright portion, the horizontal portion being disposed below the gutter and extending from adjacent the interior surface of the fascia member to adjacent the building wall, the upright portion extending upwardly from the horizontal portion along the building wall and being fixed attached thereto.

11. The fascia-gutter system of claim 8, wherein the suspending means comprises a portion of the bottom member of the gutter being disposed on and supported by at least a section of the body portion of the support brackets, wherein the body potion of at least two support brackets are positioned at a different elevations so that the bottom member of the gutter is disposed at an angle relative to the horizontal plane.

* * * * *